US005808380A

United States Patent [19]

Seith

[11] Patent Number: 5,808,380

[45] Date of Patent: Sep. 15, 1998

[54] SELF LUBRICATING VANE AIR MOTOR

[75] Inventor: Warren A. Seith, Wispering Pines, N.C.

[73] Assignee: Ingersoll-Rand Company, Woodcliff Lake, N.J.

[21] Appl. No.: 673,901

[22] Filed: Jul. 1, 1996

[51] Int. Cl.[6] ..... H02K 5/16; B25D 9/00; F01C 21/00

[52] U.S. Cl. ..... 310/90; 173/73; 418/152

[58] Field of Search ..... 310/90; 173/73; 418/152, 96

[56] References Cited

U.S. PATENT DOCUMENTS

| | | | |
|---|---|---|---|
| 3,724,918 | 4/1973 | Reinhoudt | 308/109 |
| 3,762,778 | 10/1973 | Boggs et al. | 305/14 |
| 3,884,601 | 5/1975 | Anthony | 418/90 |
| 4,079,277 | 3/1978 | Osanai | 310/90 |
| 4,326,757 | 4/1982 | Ozaki | 308/121 |
| 4,655,610 | 4/1987 | Al-Jaroudi | 384/13 |
| 4,711,620 | 12/1987 | Takahashi et al. | 418/96 |
| 4,729,729 | 3/1988 | Tarumoto et al. | 418/178 |
| 5,087,180 | 2/1992 | Clapp | 418/152 |
| 5,246,294 | 9/1993 | Pan | 384/119 |
| 5,274,289 | 12/1993 | Wrobel | 310/90 |
| 5,281,033 | 1/1994 | Ide | 384/213 |
| 5,307,881 | 5/1994 | Kimberlin | 173/62 |

FOREIGN PATENT DOCUMENTS

| | | | |
|---|---|---|---|
| 2507059 | 3/1981 | United Kingdom | F04C 2/356 |

OTHER PUBLICATIONS

U.K. Search Report dated 18 Sep. 1997 for U.K. Patent Application No. 9713623.8.

*Primary Examiner*—Steven L. Stephan
*Assistant Examiner*—Michael J. Wallace, Jr.
*Attorney, Agent, or Firm*—Walter C. Vliet; Leon Nigohosian, Jr.

[57] ABSTRACT

A vacuum impregnated porous cylinder is utilized in a vane type air motor to provide a continuous source of lubrication for the vane tips rotating within the cylinder thereby eliminating the need for lubricant dispersion in the air supply.

10 Claims, 2 Drawing Sheets

SELF LUBRICATING VANE AIR MOTOR

BACKGROUND OF THE INVENTION

This invention relates generally to vane air motors and more particularly to self lubricating vane air motors which do not require constant lubrication in operation. In typical air motors an air seal crucial to the function of the motor is created by sliding contact between the vanes and cylinder. The friction created by this contact consumes power and also causes the edge of the blade to wear quickly. Blade wear is the most common failure mode in air motors. To alleviate wear these motors must be lubricated. This is typically done by introducing oil into the air supply. However, adding lubricant to the air supply has the annoying side effect of causing oil mist to be sprayed with the tool exhaust. Not using any lubricant, however, can shorten motor life by as much as 95%.

Typical vane motors use cylinders made from non-porous materials such as bar stock or casting.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a self lubricating vane air motor comprising a motor housing; a vane type air motor disposed within the housing; a motor cylinder disposed within the air motor; a rotor having extensible vanes for contacting the cylinder during rotation to form a seal therebetween; and the improvement further comprising the motor cylinder being manufactured from a porous structural material impregnated with a lubricating fluid. In addition, in one preferred embodiment, the motor cylinder is further provided with added oil storage capacity.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
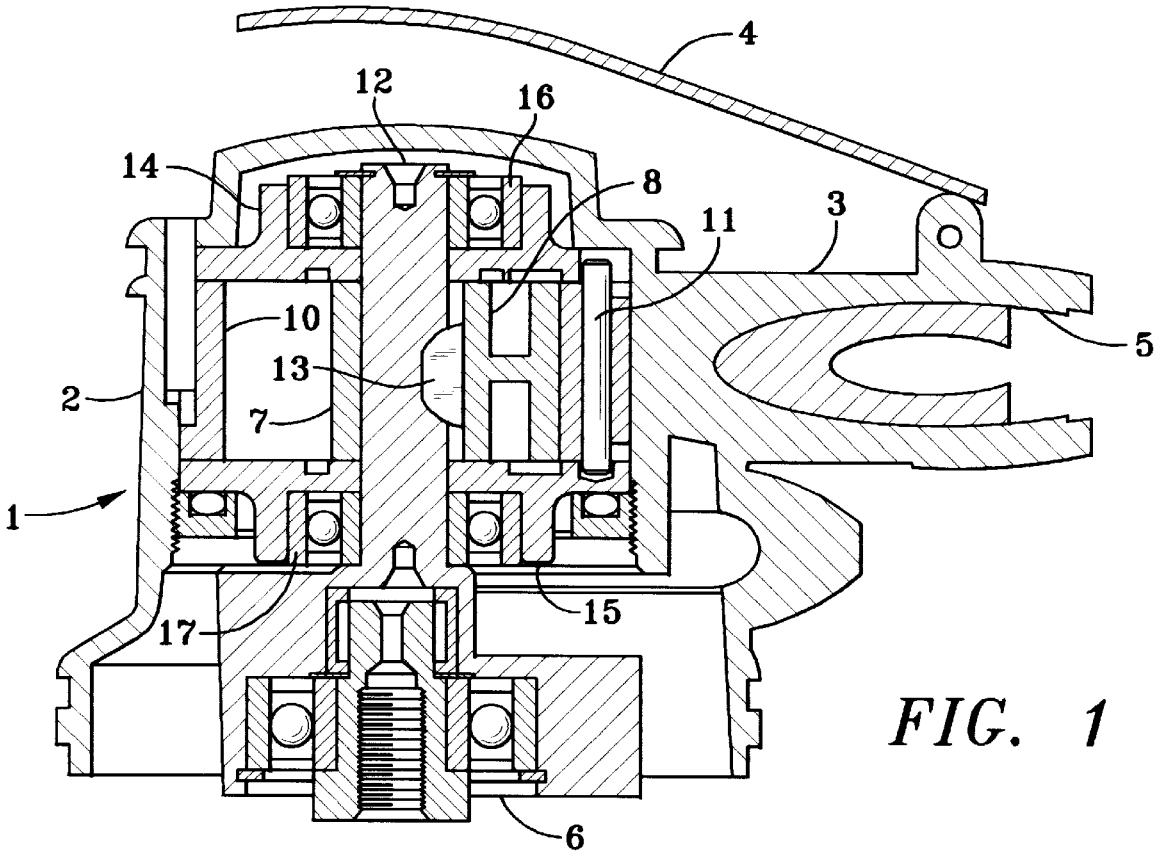
FIG. 1 is a cross section view of an orbital sander incorporating a vane air motor according to the present invention.

Referring to FIG. 1, an orbital sander according to the present invention is shown and generally designated by the reference numeral 1. The sander comprises a housing 2 having a handle stub 3 attached to it. The handle stub 3 mounts an operating lever 4 for controlling the flow of pressure fluid or air into inlet 5 which receives pressure fluid, for example air, from a source (not shown). Disposed within the housing is an orbital motion device 6 disposed for rotation with a spindle 12 which in turn is powered for rotation by means of vane rotor 7 to which it is keyed by means of half moon key 13.

Figure 2:
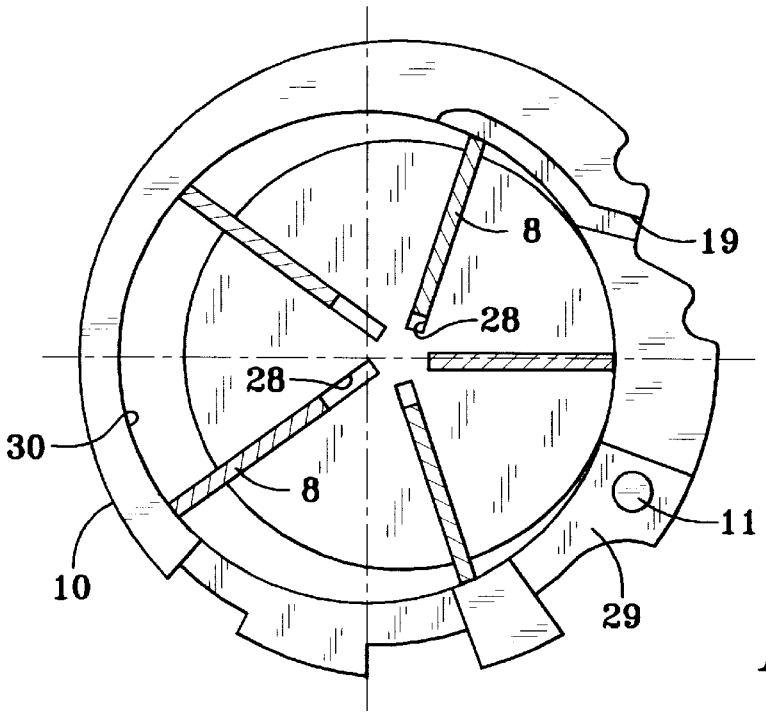
FIG. 2 is an end view of a motor cylinder and vane rotor.

The vane rotor 7 rotates within a cylinder 10 which in turn is secured in the housing 2 by means of a positioning pin 11. The cylinder 10 is further provided with an upper end cap 14 and a lower end cap 15 to form a cylinder chamber 30 (see FIG. 2). The vane rotor 7 is provided with a plurality of vane slots 28 which receive vanes 8 which are free to reciprocate within the vane slots 28. Once the actuating lever 4 is depressed, air from inlet 5 is directed to cylinder inlet 19 by various internal passages (not shown). Air entering the cylinder chamber is expanded against the extensible vanes which in turn power the vane rotor in rotation. Expanded air is exhausted through exhaust slot 29 to atmosphere. The operation is well known in the vane motor industry.

According to the present invention, the motor cylinder 10 is manufactured from a porous structural material, such as, for example, powdered metal. Further, according to one embodiment of the present invention, the cylinder 10 is vacuum impregnated with a lubricating fluid such as oil. This invention uses the porous material to retain lubricant in the cylinder of the air motor. By means of capillary action the lubricant will disperse through the interconnected porosity of the material. The pressure drop across the interface between the cylinder and vanes when the tool is running effects the porous cylinder material near the blade thereby moving lubricant radially inward and bringing it to the wear surface. This generally reduces friction at the wear surface of the cylinder without the addition of lubricant to the air supply.

Figure 3:
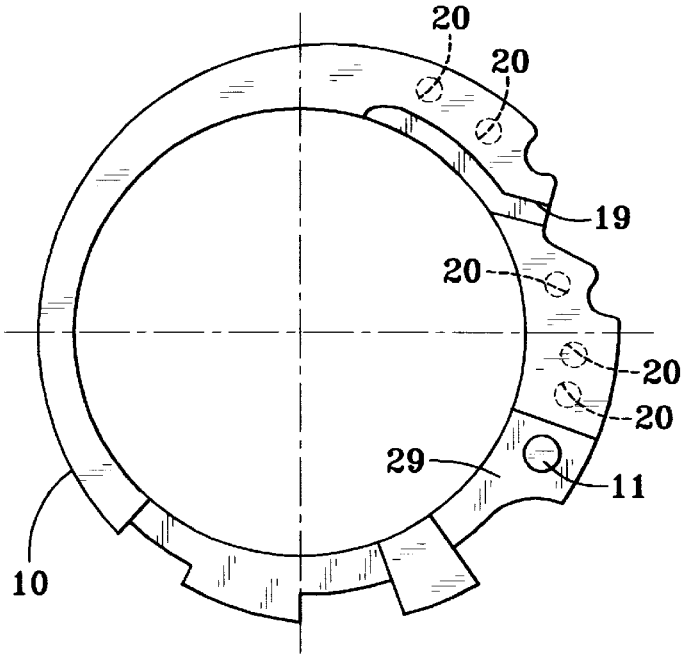
FIG. 3 is an end view of a motor cylinder according to the present invention showing a plurality of lubricating fluid storage bores.
Figure 4:
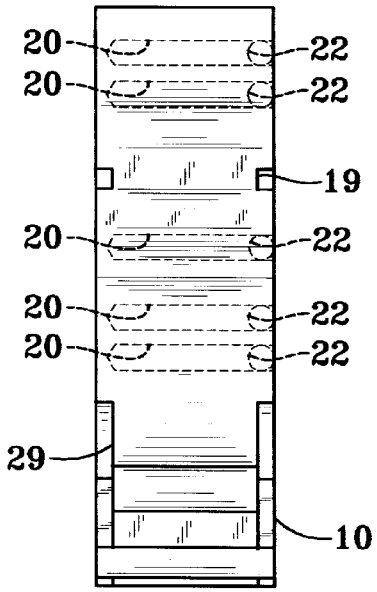
FIG. 4 is a side view of the motor cylinder according to FIG. 3.

In a second embodiment of the present invention, as shown in FIGS. 3 and 4, the porous cylinder is provided with a plurality of bores 20 in the periphery of the cylinder into which additional quantities of lubricating fluid may be inserted either through vacuum impregnation or a complimentary filling procedure. As shown in FIG. 4, the bores 20 may be closed by means of a pressed in ball 22.

Figure 5:
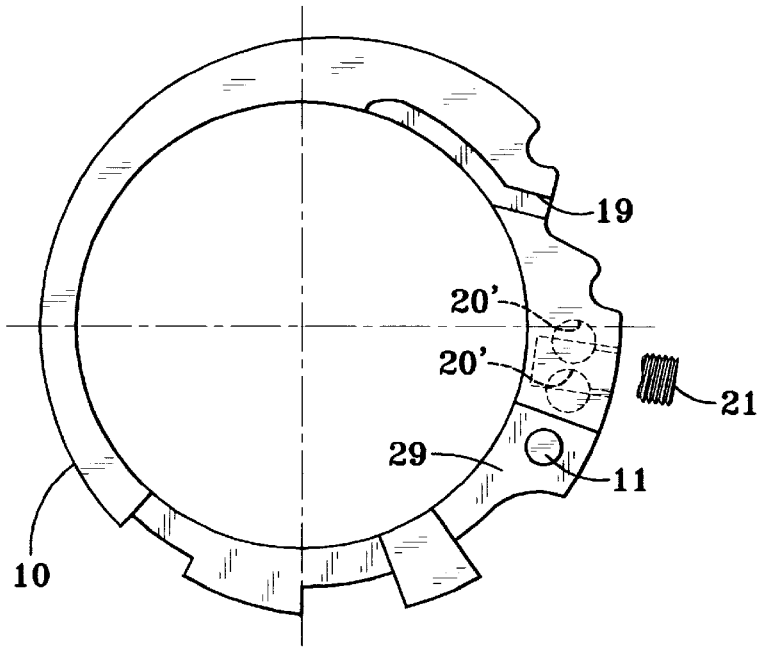
FIG. 5 is an end view of a motor cylinder according to the present invention wherein the storage bores are further provided with a means for replenishing lubricating fluid.
Figure 6:
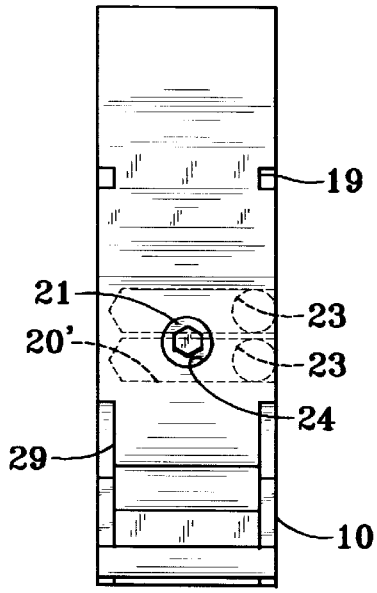
FIG. 6 is a side view of the motor cylinder according to FIG. 5.

In the embodiment shown in FIGS. 5 and 6, two user refillable bores 20' are shown closed by means of two pressed in balls 23, however, the bores are accessible through a threaded bore 24 in the periphery of the porous cylinder 10. The threaded bore 24 is closed by means of a plug 21 which may be removed from the porous cylinder either internally or through an access in the housing 2 (not shown). The removable plug 21 permits the user to refill the bores 20' to thereby extend the useful lubrication cycle.

The porous cylinder 10 in this invention acts as a storage medium for lubricant and also serves to deliver lubricant to the wear surface. The porous cylinders capacity to store lubricant is limited by the volume of its pores. The amount of lubricant that may be stored in the pores is greatly increased by means of vacuum impregnation of the lubricating oil. This invention further provides for storage chambers to increase this capacity. The storage chambers are formed by means of blind bores within the cylinder or in the alternative the bores may be provided with a removable access plug to permit user refilling.

This invention is not limited to using only powdered metal to achieve porosity. Any suitable porous structural material is contemplated and the invention is not limited to using petroleum based lubricants.

Having disclosed my invention in terms of one or more preferred embodiments, I do not wish to be limited in the scope of my invention except as claimed.

What is claimed is:

1. A self lubricating vane motor comprising:

a motor housing;

a vane type air motor disposed within said housing;

a motor cylinder disposed within said air motor;

a rotor having extensible vanes for contacting an interior surface of said cylinder, said vanes being substantially perpendicular to said interior surface of said cylinder during rotation to form a seal therebetween; and the improvement further comprising:

said motor cylinder being manufactured from a porous structural material impregnated with a lubricating fluid and is further provided with means for storing an additional volume of lubricating fluid comprising a bore disposed in said motor cylinder filled with a quantity of lubricating fluid in excess of the capacity of the porous material removed from said bore.

2. A self lubricating vane motor according to claim 1 wherein:

said motor cylinder is manufactured from a porous powdered metal impregnated with lubricating oil.

3. A self lubricating vane motor according to claim 1 wherein:

said means for storing additional lubricating fluid comprises a plurality of bores disposed about the periphery of said motor cylinder.

4. A self lubricating vane motor according to claim 1 wherein:

said bore is closed within said motor cylinder.

5. A self lubricating vane motor according to claim 1 wherein:

said bore is further provided with a second threaded bore and a removable threaded plug to permit user relubrication.

6. A self lubricating vane motor comprising:

a motor housing;

a vane type air motor disposed within said housing;

a motor cylinder disposed within said air motor;

a rotor having extensible vanes for contacting an interior surface of said cylinder, said vanes being substantially perpendicular to said interior surface of said cylinder during rotation to form a seal therebetween; and the improvement further comprising:

said motor cylinder being manufactured from a porous structural material which is vacuum impregnated with a lubricating fluid and is further provided with means for storing an additional volume of lubricating fluid comprising a bore disposed in said motor cylinder filled with a quantity of lubricating fluid in excess of the capacity of the porous material removed from said bore.

7. A self lubricating vane motor according to claim 6 wherein:

said motor cylinder is manufactured from a porous powdered metal impregnated with lubricating oil.

8. A self lubricating vane motor according to claim 6 wherein:

said means for storing additional lubricating fluid comprises a plurality of bores disposed about the periphery of said motor cylinder.

9. A self lubricating vane motor according to claim 6 wherein:

said bore is closed within said motor cylinder.

10. A self lubricating vane motor according to claim 6 wherein:

said bore is further provided with a second threaded bore and a removable threaded plug to permit user relubrication.

* * * * *